US005752567A

United States Patent [19]

Obosu

[11] Patent Number: 5,752,567

[45] Date of Patent: May 19, 1998

[54] HEAT EXCHANGER FIN STRUCTURE

[75] Inventor: Charles B. Obosu, Oklahoma City, Okla.

[73] Assignee: York International Corporation, York, Pa.

[21] Appl. No.: 760,287

[22] Filed: Dec. 4, 1996

[51] Int. Cl.[6] ..... F28D 1/04; F28F 1/32

[52] U.S. Cl. ..... 165/151; 165/182; 165/DIG. 502; 165/DIG. 503

[58] Field of Search ..... 165/151, 182, 165/906, DIG. 502, DIG. 503

[56] References Cited

U.S. PATENT DOCUMENTS

| | | | |
|---|---|---|---|
| 3,759,050 | 9/1973 | Slaasted et al. . | |
| 3,902,551 | 9/1975 | Lim et al. . | |
| 4,365,667 | 12/1982 | Hatada et al. . | |
| 4,434,844 | 3/1984 | Sakitani et al. . | |
| 4,469,167 | 9/1984 | Itoh et al. . | |
| 4,580,624 | 4/1986 | Ishida et al. . | |
| 4,691,768 | 9/1987 | Obosu . | |
| 4,705,105 | 11/1987 | Cur . | |
| 4,723,599 | 2/1988 | Hanson | 165/151 |
| 4,860,822 | 8/1989 | Sacks . | |
| 4,909,319 | 3/1990 | Ishikawa et al. . | |
| 4,923,002 | 5/1990 | Haussmann . | |
| 5,042,576 | 8/1991 | Broadbent | 165/151 |
| 5,062,475 | 11/1991 | Bemisderfer et al. . | |
| 5,099,914 | 3/1992 | Reifel . | |
| 5,121,613 | 6/1992 | Cox et al. . | |
| 5,509,469 | 4/1996 | Obosu . | |
| 5,582,244 | 12/1996 | Helms et al. | 165/151 |

FOREIGN PATENT DOCUMENTS

| | | | |
|---|---|---|---|
| 58-158495 | 9/1983 | Japan . | |
| 60-216188 | 10/1985 | Japan . | |
| 61-243291 | 10/1986 | Japan | 165/151 |
| 62-175590 | 8/1987 | Japan . | |
| 62-194194 | 8/1987 | Japan . | |
| 1-256795 | 10/1989 | Japan | 165/151 |
| 1-305297 | 12/1989 | Japan . | |
| 5-45085 | 2/1993 | Japan | 165/151 |

*Primary Examiner*—Allen J. Flanigan
*Attorney, Agent, or Firm*—Finnegan, Henderson, Farabow, Garrett, & Dunner, L.L.P.

[57] ABSTRACT

A heat exchanger having a plurality of tubes for circulating a refrigerant fluid and a plurality of fins in heat exchange contact with the plurality of tubes. Each of the fins includes a plurality of aligned collars defining at least one row of longitudinally spaced apertures, the plurality of tubes extending through the apertures and engaged by the collars. A pair of reinforcing ribs extend longitudinally of the fin, one of the pair on each side of the at least one row of apertures. A plurality of longitudinally spaced flat portions, lying in a common plane, and extend transversely between the ribs, one of the flat portions circumscribing each of the collars. A plurality of central corrugated portions transversely spaced from the ribs, extend longitudinally, one of the corrugated portions lying between each two of the flat portions. At least two sets of longitudinally extending louvers are located transversely between the central corrugated portion and the ribs and longitudinally between the flat portions.

8 Claims, 3 Drawing Sheets

16
18
20
22
24
24a
26
26a
26b
30
30a
30c
30d
32
32a
32c
32d
34
36
4
5
6

HEAT EXCHANGER FIN STRUCTURE

BACKGROUND OF THE INVENTION

The present invention relates to heat exchangers, and, more particularly, to fins for transfer of heat between a gaseous medium, such as air, and a fluid circulating in tubes in contact with the fins.

The efficiency of refrigeration systems, such as air conditioners and heat pumps, is dependent in substantial measure on the efficiency of heat transfer between a refrigerant fluid circulated through tubes and air pumped in heat exchange relation with the refrigerant fluid in a heat exchanger containing the tubes. The efficiency of heat transfer between air and a heat conductor associated with the refrigerant fluid, in turn, is enhanced by avoiding laminar flow of the air over heat conductor.

For this reason, highly sophisticated fin structures have been designed and employed in the heat exchangers of various refrigerating systems.

Typically, such fin structures have been formed from very thin heat conductor material, such as aluminum, to provide increased heat transfer to and from the circulated air. The heat transfer is further enhanced by surface formations on or in the fins that limit the growth of velocity and heat transfer boundary layers, and by which air flow over the fins is locally rendered highly turbulent and mixed. The surface formations have included various types of configurations stamped or otherwise formed in the fins such as louvers, raised lances, corrugations, holes of various shapes and combinations of these surface formation configurations.

The efficiency of heat transferred to and from the air forced into contact with the heat exchanger fins is augmented by increased fin density or by an increase in the number of fins in contact with the refrigerant containing tubes for a given unit of tube length. For this reason, the design of heat exchanger fins has emphasized thinness in the stock material from which the fins are stamped or otherwise formed. While increased fin density and enhanced heat transfer efficiency is accomplished by using very thin materials, problems are encountered because of the reduced mechanical strength of fins using such thin materials. These problems occur especially during the fabrication handling and assembly of the fins with the tubes of the heat exchanger.

Thus, there is a need for a heat exchanger fin design which is adequately thin to accommodate high fin density but which provides enhanced mechanical strength in the otherwise fragile thin fin material.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the heat exchanger of invention comprises a plurality of tubes for circulating a refrigerant fluid and a plurality of fins in heat exchange contact with the plurality of tubes. Each of the fins includes a plurality of aligned collars defining at least one row of longitudinally spaced apertures, the plurality of tubes extending through the apertures and engaged by the collars. A pair of reinforcing ribs extend longitudinally of the fin, one of the pair on each side of the at least one row of apertures. A plurality of longitudinally spaced flat portions, lying in a common plane, and extend transversely between the ribs, one of the flat portions circumscribing each of the collars. A plurality of central corrugated portions transversely spaced from the ribs, extend longitudinally, one of the corrugated portions lying between each two of the flat portions. At least two sets of longitudinally extending louvers are located transversely between the central corrugated portion and the ribs and longitudinally between the flat portions.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate a preferred embodiment of the invention and together with the description, serve to explain the principles of the invention. In the drawings.

DESCRIPTION OF THE PREFERRED EMBODIMENT

Figure 1:
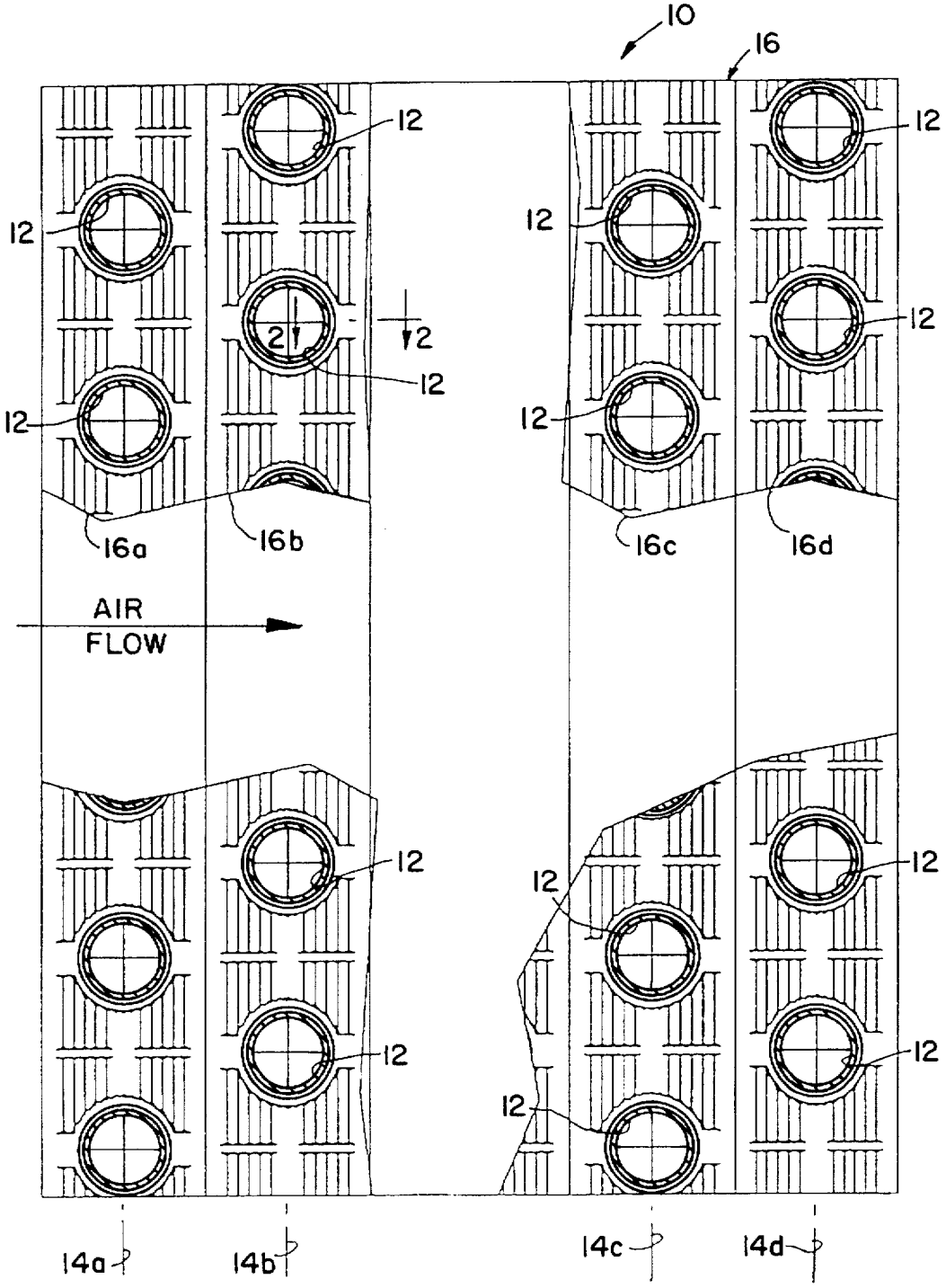
FIG. 1 is a fragmentary cross section illustrating a heat exchanger in accordance with the invention.

Reference will now be made in detail to the present preferred embodiment of the invention, an example of which is illustrated in the accompanying drawings. Wherever possible, the same reference numbers will be used throughout the drawings to refer to the same or like parts.

In accordance with the present invention, a heat exchanger is provided which includes a plurality of tubes for circulating a refrigerant fluid and a plurality of fins in heat exchange contact with the plurality of tubes. In the embodiment illustrated in FIGS. 1 and 2 of the drawings, the heat exchanger is generally designated by the reference numeral 10 and includes a plurality of refrigerant containing tubes 12 arranged in rows 14*a*, 14*b*, 14*c* and 14*d*. Although only four such rows are designated in FIG. 1, it will be appreciated that the principles of the heat exchanger will apply irrespective of the particular number of rows, which may vary from one to any practical number depending on the desired capacity of a refrigeration system, for example, in which the heat exchanger is used.

Figure 2:
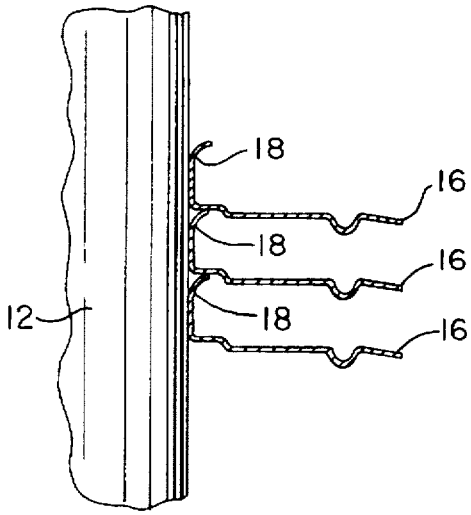
FIG. 2 is an enlarged fragmentary cross section on line 2—2 of FIG. 1.

A plurality of fins 16 are arranged in heat exchange contact with the tubes 12 as shown generally in FIG. 2 and as will be described in more detail below. In FIG. 1 a single multistrip fin 16 is illustrated having a number of strip portions 16*a*, 16*b*, 16*c* and 16*d* corresponding to the number of rows 14*a*–14*d* in the heat exchanger 10. Although the fin strips 16*a*–16*d* in FIG. 1 are joined to establish a single fin in any cutting plane of the heat exchanger 10, each of the strips is identical and any one of them may function as a fin in the context of the operating principles of the heat exchanger 10, as will be appreciated from the description to follow.

Also, as the heat exchanger 10 is used in practice, the tubes 12 extend horizontally and the fins 16 lie in vertical planes. The rows 14*a*–14*d* in which the tubes 12 are aligned may extend vertically as shown in FIG. 1. In certain applications of the heat exchanger, however, the rows 14*a*–14*b* may be inclined to vertical at an angle up to 45° though more commonly at an angle no greater than 30° to vertical.

In accordance with the present invention, each of the heat exchanger fins includes a plurality of aligned collars defining a row of longitudinally spaced apparatures through which the tubes extend to be engaged by the collars, a pair of longitudinally extending reinforcing ribs one of the pair on each side of the row of apparatures, a plurality of longitudinally spaced flat portions lying in a common plane and extending transversely between the ribs, one of the flat portions circumscribing each of the collars, a plurality of longitudinally extending central corrugated portions transversely spaced from the ribs, one of the corrugated portions extending between each two of the flat portions, and at least two sets of longitudinally extending louvers, one of the sets located respectively between the central corrugated portion in the ribs.

Figures 3, 5, 6, 7:
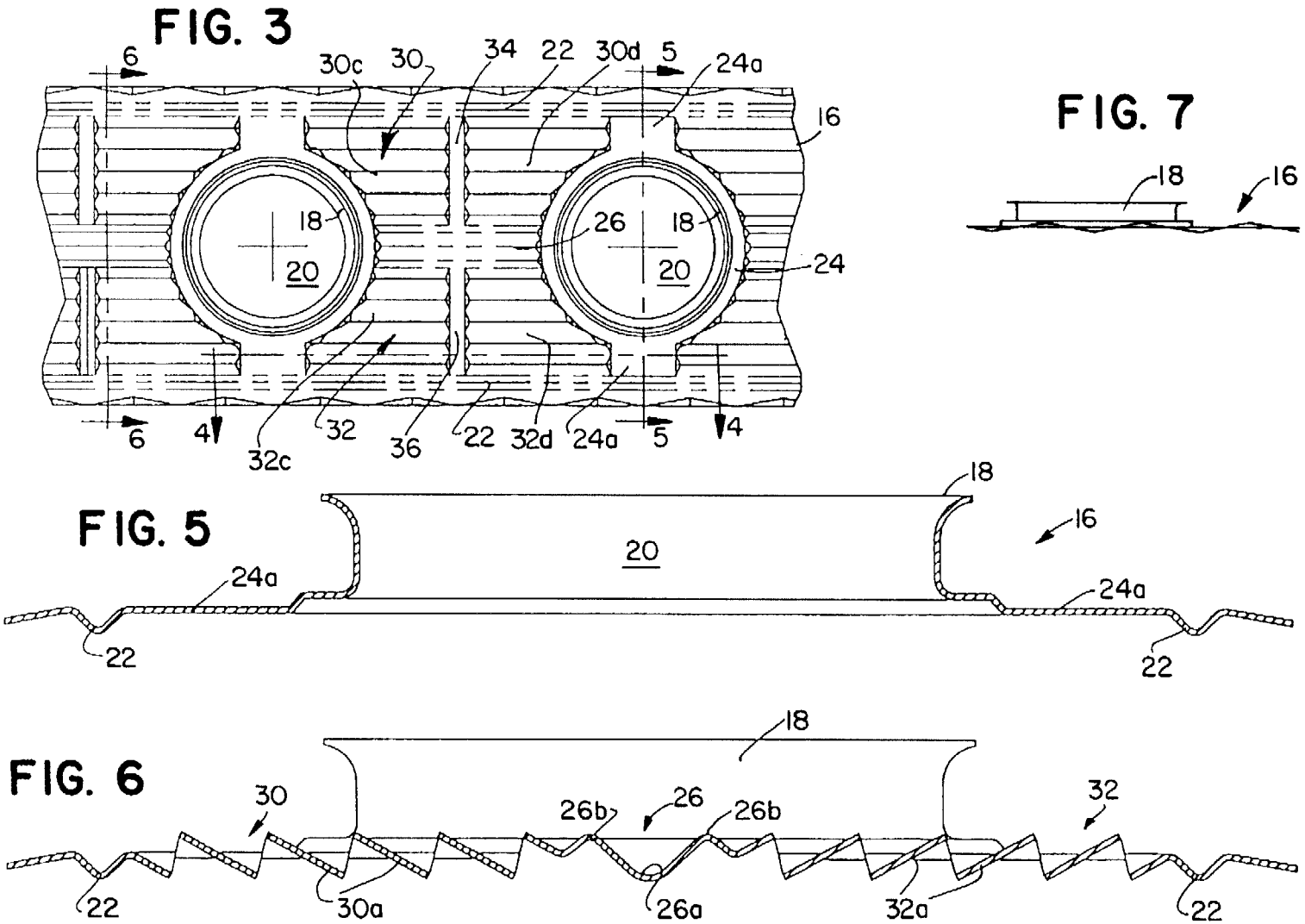
FIG. 3 is an enlarged fragmentary plan view illustrating a fin used in the heat exchanger of FIG. 1.
FIG. 5 is a further enlarged cross section on line 5—5 of FIG. 3.
FIG. 6 is an enlarged fragmentary cross section on line 6—6 of FIG. 3.
FIG. 7 is a fragmentary side elevation from one edge of the fin shown in FIG. 3.

In the illustrated embodiment, and as shown most clearly in FIGS. 3, 5 and 6 of the drawings, collars 18 project from one side of the fin 16 and define apertures 20 through which the tubes 12 extend in heat exchange contact with the collars. In this respect, FIG. 2 illustrates the arrangement of the tubes 12 extending through the collars 18. Extending along each side of the strip 16 are reinforcing ribs 22 of generally V-shaped cross section as shown in FIGS. 5 and 6. Circumscribing each of the collars 18 is a flat portion 24 having diametrically opposite tab-like extensions 24*a* extending transversely to the ribs 22. The flat portions 24 of the several collars lie in a common plane throughout each fin 16.

A central corrugated portion extends between the flat portions 24 circumscribing each two of the collars 18. The cross-sectional configuration of the corrugated portion 26 is shown most clearly in FIG. 6 to include a central valley portion 26*a* projecting from one side of the common plane of the flat portions 24 and a pair of crest portions 26*b* projecting to the opposite side of that common plane. Also it would be noted that the distance through which the valley 26*a* projects from one side of the common plane is greater than the distance through which the crest portions 26*b* project on the opposite side of the common plane.

Situated transversely between the corrugated portion 26 and each of the reinforcing ribs 22 are sets 28 and 30 of oppositely inclined louvers 30*a* and 32*a*. The louvers extend between the flat portions 24 circumscribing the collars 18 and are struck out from the material of the fin 16 to project symmetrically from the common plane of the flat portions 24. Although the two louver sets 30 and 32 may extend through a length between the flat portions 24, in accordance with the invention, it is preferred that the two louver sets 30 and 32 be further divided into subsets 30*c*, 30*d* and 32*c*, 32*d* by a pair of flat strip portions 34 and 36, which extend in the common plane of the flat portions 24 and between the central corrugated portion 26 and the reinforcing ribs 22. In this way, the enhanced resistance to bending due to the cross-sectional configuration of the central corrugated portion 26 and the reinforcing ribs 22 contribute to support of the louvers 30*a* and 30*b* between the collars 18.

Figure 4:
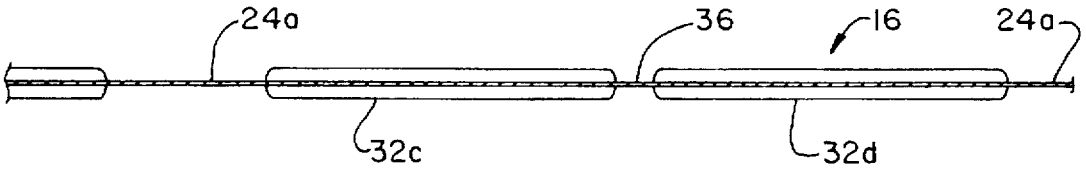
FIG. 4 is an enlarged fragmentary cross section on line 4—4 of FIG. 3.

The co-planar relationship of the flat portions 24, 24*a* and the flat strip portions 34, 36 is illustrated in FIG. 4 of the drawings. Also, as shown in FIG. 7 of the drawings, the edges of the fin 16 outside of the reinforcing ribs 22 are longitudinally serrated to further strengthen and augment the characteristics of air flow over the fin 16.

In addition to the stuctural or strengthening functions served by the V-shaped reinforcing ribs 22 and the central corrugated portions 26, these portions of the fin 16 serve to collect liquid condensate and isolate it from the air stream passing about the louvers 30*a* and 32*a*. For example, condensate originating at the tubes 12 will drain into the relatively deep valley portions 26*a* and be kept from the air flow across the crests 26*b* of the central corrugated portion 26. Similarly condensate from the tubes 12 may be carried by the tab-like extensions of the flat portions 24 into the V-shape of the reinforcing ribs 22.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A heat exchanger comprising:

a plurality of tubes for circulating a refrigerant fluid; and a plurality of fins in heat exchange contact with said plurality of tubes, each of said fins including:

a plurality of aligned collars defining at least one row of longitudinally spaced apertures, the plurality of tubes extending through said apertures and engaged by said collars, a pair of longitudinally extending reinforcing ribs, one of said pair on each side of the at least one row of apertures, a plurality of longitudinally spaced flat portions lying in a common plane and extending transversely between said ribs, one of said flat portions circumscribing each of said collars, a plurality of longitudinally extending central corrugated portions transversely spaced from said ribs, one of said corrugated portions extending between each two of said flat portions, and at least two sets of longitudinally extending louvers, said sets of louvers being located transversely between said central corrugated portion and said ribs and longitudinally between said flat portions.

2. The heat exchanger of claim 1, wherein each of said fins includes a pair of flat strip portions located in said common plane and longitudinally between said flat portions, each of said pair of flat strip portions extending transversely from opposite sides of said central corrugated portion to said reinforcing ribs and dividing said at least two sets of louvers into at least four sets of louvers.

3. The heat exchanger of either one of claims 1 and 2, wherein the louvers on opposite sides of said central corrugated portions are inclined in opposite directions.

4. The heat exchanger of claim 3, wherein said louvers project symmetrically from said common plane.

5. The heat exchanger of claim 1, wherein said central corrugated portions each include in transverse section, a central valley formation between a pair of crest formations.

6. The heat exchanger of claim 5, wherein said central valley formation and said pair of crest formations project from opposite sides of said common plane.

7. The heat exchanger of claim 6, wherein said central valley formation projects from said common plane farther than said pair of crest formations.

8. The heat exchanger of claim 1, wherein each of said reinforcing ribs comprises a generally V-shaped transverse section.

* * * * *